US008721398B2

(12) United States Patent
Huang et al.

(10) Patent No.: US 8,721,398 B2
(45) Date of Patent: May 13, 2014

(54) GRINDING APPARATUS FOR REMOVING PROCESSING DEBRIS

(75) Inventors: Teng-Tsung Huang, New Taipei (TW); Yong-Bing Hu, Shenzhen (CN); Yuan-Zhao Li, Shenzhen (CN); Zhan Shang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 324 days.

(21) Appl. No.: 13/274,560

(22) Filed: Oct. 17, 2011

(65) Prior Publication Data

US 2012/0196517 A1 Aug. 2, 2012

(30) Foreign Application Priority Data

Jan. 28, 2011 (CN) ..... 2011 1 0031037

(51) Int. Cl.
*B24B 55/02* (2006.01)

(52) U.S. Cl.
USPC ..... 451/294; 451/488; 451/449

(58) Field of Classification Search
CPC ..... B24B 55/02; B24B 53/095; B24B 37/00; B24B 55/06; B24B 7/08
USPC ..... 451/7, 53, 294, 488, 449
See application file for complete search history.

(56) References Cited

U.S. PATENT DOCUMENTS

| | | | | | |
|---|---|---|---|---|---|
| 3,913,274 | A | * | 10/1975 | Raiford et al. | 451/5 |
| 4,448,359 | A | * | 5/1984 | Meyers | 241/46.012 |
| 4,471,579 | A | * | 9/1984 | Bovensiepen | 451/7 |
| 4,484,418 | A | * | 11/1984 | Reich et al. | 451/41 |
| 4,750,297 | A | * | 6/1988 | Anderson | 451/296 |
| 4,955,162 | A | * | 9/1990 | Jackson | 451/279 |
| 5,113,622 | A | * | 5/1992 | Nishiguchi et al. | 451/7 |
| 5,197,228 | A | * | 3/1993 | Sharkey et al. | 451/5 |
| 5,331,769 | A | * | 7/1994 | Walton | 451/249 |
| 5,400,547 | A | * | 3/1995 | Tanaka et al. | 451/287 |
| 5,419,732 | A | * | 5/1995 | Kaneko et al. | 451/28 |
| 5,605,487 | A | * | 2/1997 | Hileman et al. | 451/5 |
| 6,206,760 | B1 | * | 3/2001 | Chang et al. | 451/41 |
| 6,641,459 | B2 | * | 11/2003 | Ball | 451/5 |
| 6,726,529 | B2 | * | 4/2004 | Marcyk et al. | 451/7 |
| 2005/0009454 | A1 | * | 1/2005 | Mundt | 451/53 |
| 2008/0038991 | A1 | * | 2/2008 | Hunter et al. | 451/7 |

FOREIGN PATENT DOCUMENTS

| | | |
|---|---|---|
| CN | 101708590 A | 5/2010 |
| TW | 573589 | 1/2004 |

* cited by examiner

*Primary Examiner* — George Nguyen
(74) *Attorney, Agent, or Firm* — Novak Druce Connolly Bove + Quigg LLP

(57) ABSTRACT

A grinding apparatus includes a base, a case, a transmission module, an inlet water module and drain module. The case is positioned on the base. The transmission module is positioned on the base, and includes a motor and a grinding plate. The motor drives the grinding plate to rotate. The inlet water module is configured for feeding water onto the grinding plates. The drain module includes a drain pan and a drain pipe. The drain pan is detachably attached to the case, the drain pipe is connected to the drain pan, and is exposed from the case.

12 Claims, 5 Drawing Sheets

GRINDING APPARATUS FOR REMOVING PROCESSING DEBRIS

BACKGROUND

1. Technical Field

The present disclosure generally relates to machining apparatuses, and particularly to a grinding apparatus which can remove processing debris.

2. Description of Related Art

Grinding apparatuses are used for mechanically grinding surfaces of workpieces. However, during the grinding process, scrap/processing debris may collect on the grinding plate, and penetrate the grinding apparatus. It is difficult to clean such debris from grinding apparatuses.

Therefore, there is room for improvement within the art.

BRIEF DESCRIPTION OF THE DRAWINGS

Many aspects of the grinding apparatus can be better understood with reference to the following drawings. The components in the drawings are not necessarily to scale, the emphasis instead being placed upon clearly illustrating the grinding apparatus. Moreover, in the drawings, like reference numerals designate corresponding parts throughout the several views.

DETAILED DESCRIPTION

Figure 1:
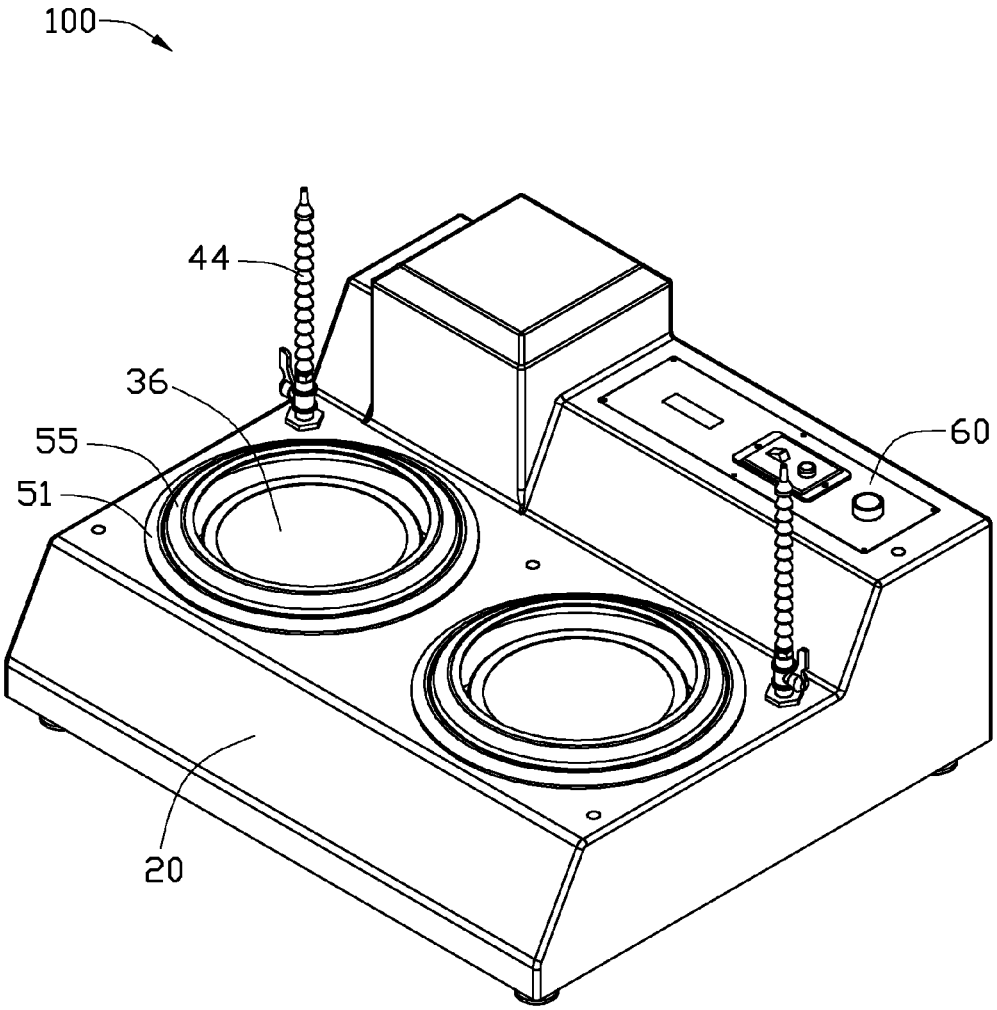
FIG. 1 is an exploded view of a grinding apparatus according to an exemplary embodiment.
Figure 2:
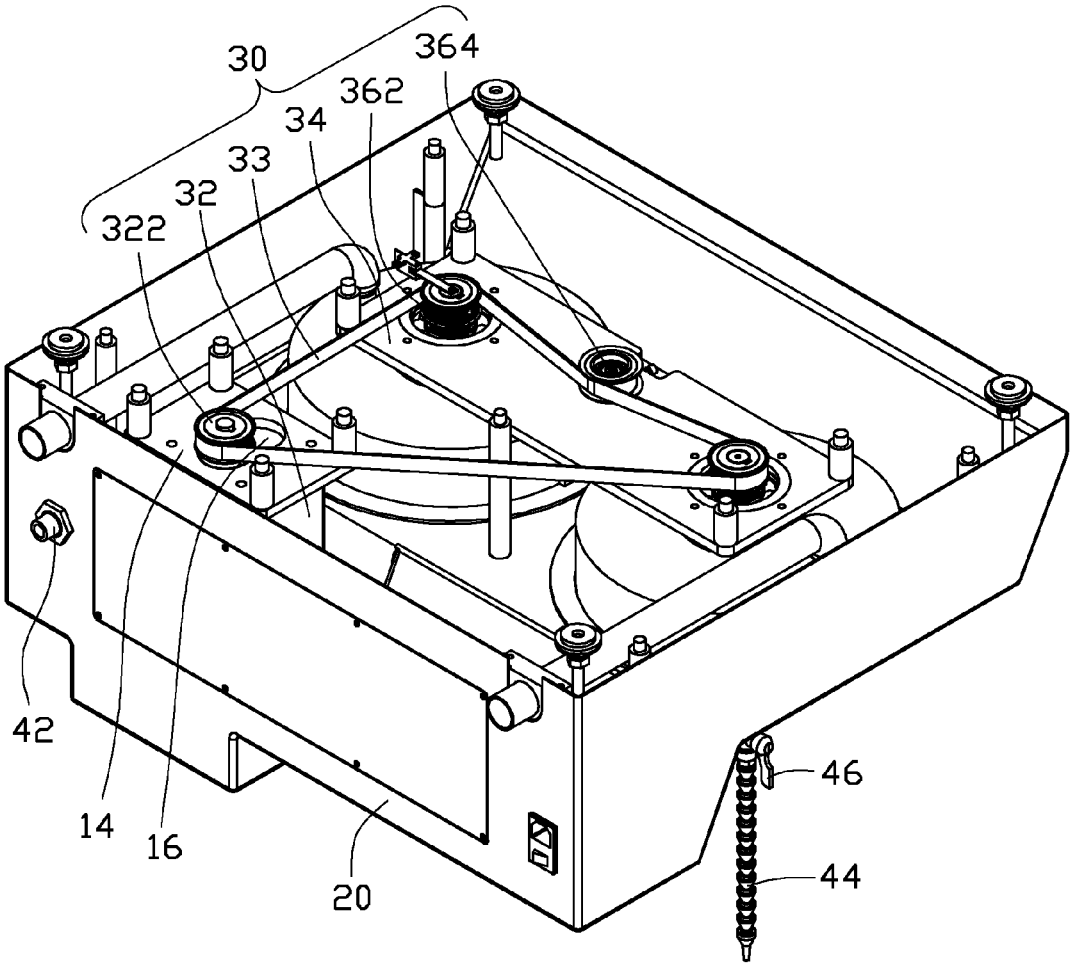
FIG. 2 is similar to FIG. 1, but shown from another aspect.
Figure 3:
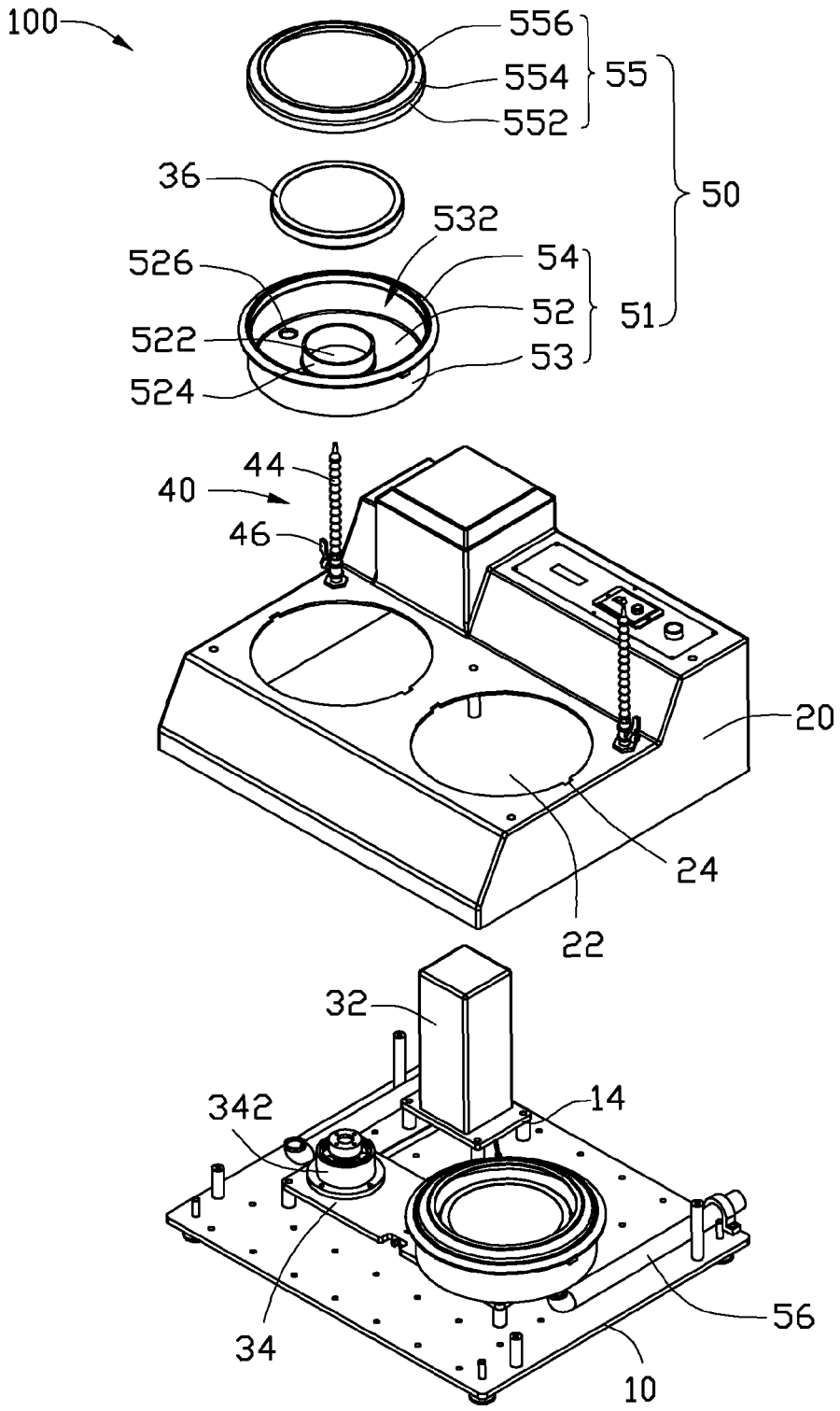
FIG. 3 is an exploded view of the grinding apparatus in FIG. 1.

FIGS. 1 to 3 show an exemplary embodiment of a grinding apparatus 100 for grinding a workpiece. The grinding apparatus 100 a case 20, a transmission module 30, an inlet water module 40, two drain modules 50, and a control panel 60 all supported on a base 10.

Referring to FIG. 3, a seat 14 is formed on the base 10. Referring to FIG. 2 again, an opening 16 is defined in the seat 14.

The case 20 is configured for covering the transmission module 30. The case 20 defines two through holes 22. Opposite notches 24 are defined at opposite ends of a diameter of each through hole 32.

The transmission module 30 includes a motor 32, a drive pulley 322, a belt 33, a support plate 34, two shafts 342, two grinding plates 36, two driven pulleys 362, and an idler pulley 364. The motor 32 is mounted on the seat 14. The drive pulley 322 is fixed to the motor 32 and extends out the opening 16. The motor 32 can rotate the drive pulley 322. The support plate 34 is disposed on the base 10. The shafts 342 are rotatably connected to the support plate 34. Each grinding plate 36 is detachably assembled to one end of a corresponding shaft 342. Each driven pulley 362 is mounted to the other end of a corresponding shaft 342. The idler pulley 364 is assembled on the support plate 34, and is disposed between the driven pulleys 362. The belt 33 is fitted around the drive pulley 322, the idler pulley 364, and the driven pulleys 362. When the motor 32 runs, the drive pulley 322 rotates, which rotates the belt 33, which in turn, rotates the driven pulleys 362. Accordingly, the grinding plates 36 are driven to rotate and can be used to grind the workpiece. The idler pulley 364 abuts against the belt 33 for adjusting tension of the belt 33.

The inlet water module 40 is used for feeding water onto the grinding plates 36 to wash debris away during grinding. The inlet water module 40 includes an inlet 42 and two operating pipes 44. The inlet 42 is positioned to connect to a water supply. The operating pipes 44 can be made of a flexible material such as rubber. A first end of the operating pipes 44 is connected to the entrance 42, and a second end of the operating pipes 44 are exposed from the case 20. The second end of the operating pipes 44 is vertically positioned on the case 20, and is adjacent to the grinding plates 36. In use, the operating pipes 44 can be bent to aim water flow onto the grinding plates 36. In this exemplary embodiment, a valve 46 is positioned on each operating pipe 44 for opening or closing the water flow.

Figure 4:
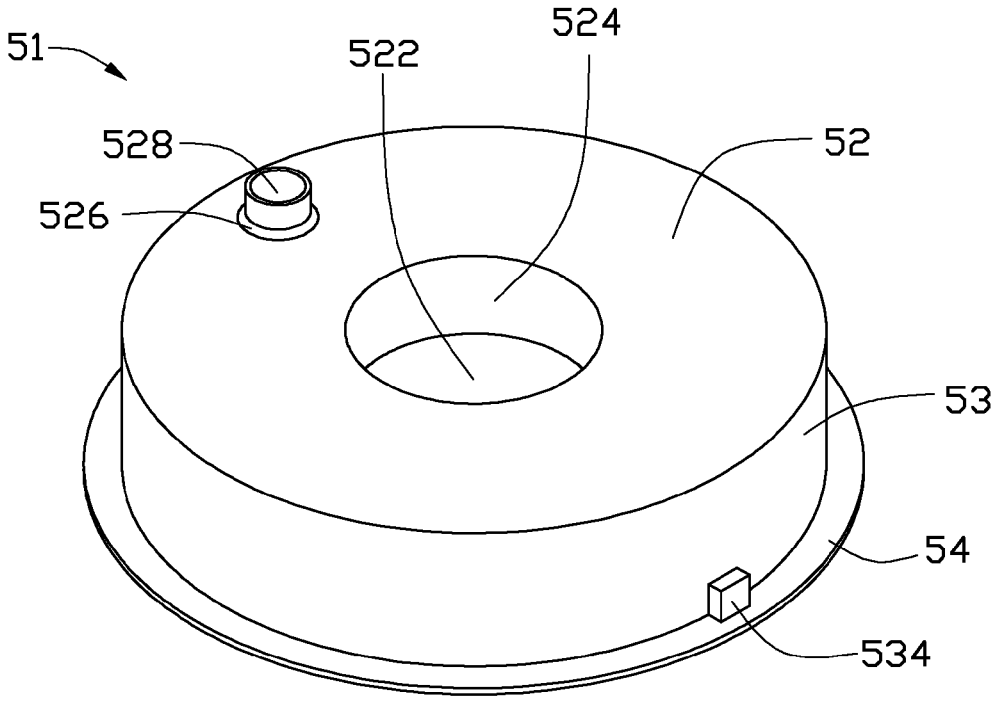
FIG. 4 is an enlarged view of a drain pan in FIG. 3 from another aspect.
Figure 5:
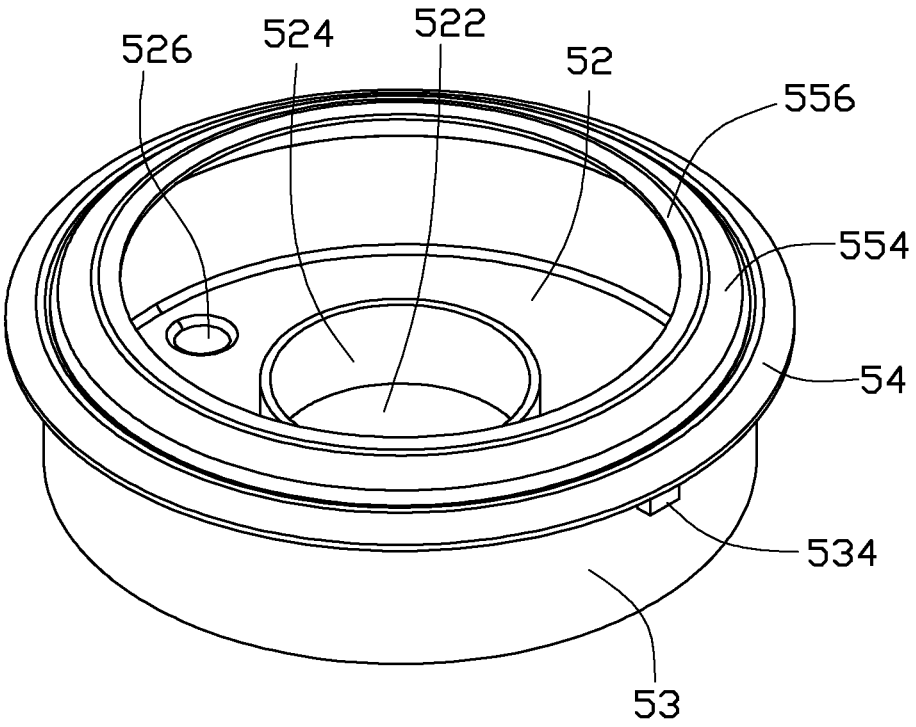
FIG. 5 is an assembled view of the drain pan attached to a waterproof ring.

Referring to FIGS. 3 and 4, each drain module 50 is configured for removing the water with the debris. The drain module 50 includes a drain pan 51, a waterproof ring 55, and a drainpipe 56. The drain pan 51 is detachably attached to the case 20. In this exemplary embodiment, the drain pan 51 includes a bottom wall 52, a peripheral wall 53, and a flange 54. The bottom wall 52 is received in the through hole 22. The bottom wall 52 includes a guide hole 522 defined in a central area thereof and a sleeve 524 formed around the guide hole 522. A receiving chamber 532 is defined between the sleeve 524 and the peripheral wall 53 for accommodating the grinding plate 36. The sleeve 524 is configured for being fitted around the shaft 342 to rotate together. The sleeve 524 may prevent the water from entering the grinding apparatus. The bottom wall 52 defines an outlet 526, and a connecting pipe 528 is joined to the outlet 526. Two latching blocks 534 are formed on the peripheral wall 53, and are positioned in the notches 24 for preventing the drain pan 51 from vibrating during grinding process. The flange 54 extends from the peripheral wall 53 and abuts against the case 20.

The waterproof ring 55 is covered on the drain pan 51 for preventing the water from splashing from the drain pan 51. The waterproof ring 55 includes a latching portion 552, a connecting portion 554 and a brim portion 556. When the waterproof ring 55 is attached to the drain pan 51, the latching portion 552 abuts against the flange 54. The connecting portion 554 and the brim portion 556 are substantially parallel to the bottom wall 52. When the waterproof ring 55 is attached to the drain pan 51, the flange 54, the connecting portion 554, and the brim portion 556 are stepped. The drain pipe 56 is positioned on the base 10. One end of the drain pipe 56 is connected to the connecting pipe 528, and the other end thereof is exposed from the case 20. If the drain pipe 56 is obstructed by debris, the grinding plate 36 and the drain pan 51 may be detached from the grinding apparatus 100 to allow manual removal of the debris. The case 20 does not need to be detached. Thus, the maintenance is convenient. The control panel 60 is positioned on the case 20 for controlling the motor 32.

In assembly, the motor 32 is mounted to the seat 14 of the base 10. The drive pulley 322 is fixed to the motor 32 from the opening 16 to rotate together. The shafts 342 are rotatably connected to the support plate 34. Each grinding plate 36 is assembled to one end of a corresponding shaft 342. Each driven pulley 362 is mounted to the other end of a corresponding shaft 342. The idler pulley 364 is assembled to the support plate 34, and is disposed between the driven pulleys 362. The belt 33 is fitted around the drive pulley 322, the idler pulley 364 and the driven pulleys 362. Then, the drain pans 51 are assembled to the case 20. The latching blocks 534 are positioned in the notches 24 for preventing the drain pan 51 from vibrating during grinding process, and the flange 54 abut against the case 20. The case 20 and the drain pans 51 are together attached to the base 10. The sleeves 524 are fitted around the shafts 342. The drain pipes 56 are connected to the connecting pipes 528. Finally, two grinding plate 36 are fitted around the shafts 342. Accordingly, the grinding apparatus is assembled.

In use, the control panel 60 is turned on to drive the motor 32 to rotate. The drive pulley 322 rotates, and further brings the belt 33 to move. Thus, the driven pulleys 362 are driven to rotate. Accordingly, the grinding plates 36 are driven to rotate for grinding workpiece. When the grinding plates 36 accumulate debris, the operating pipes 44 can be bent to allow the water in the operating pipes 44 to flow onto the grinding plates 36. The water will bring the debris to flow into the chamber 532, and flow out from the drain pipes 56.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A grinding apparatus comprising:

a base;

a case positioned on the base;

a transmission module positioned on the base, and including a motor and a grinding plate, the motor driving the grinding plate to rotate;

an inlet water module configured for feeding water onto the grinding plates;

a drain module including a drain pan and a drain pipe, the drain pan detachably attached to the case, the drain pipe connected to the drain pan, and exposed from the case;

wherein the drain pan includes a bottom wall, a peripheral wall and a flange, the bottom wall includes a guide hole and a sleeve formed around the guide hole, and a receiving chamber is defined between the sleeve and the peripheral wall, and the flange extends from the peripheral wall.

2. The grinding apparatus as claimed in claim 1, wherein the bottom wall defines an outlet, and a connecting pipe is joined to the outlet, and the drain pipe is connected to the connecting pipe.

3. The grinding apparatus as claimed in claim 1, wherein two latching blocks are formed on the peripheral wall, the case defines a through hole, opposite notches are defined at opposite ends of a diameter of the through hole, the latching blocks are positioned in the notches for preventing the drain pan from vibrating.

4. The grinding apparatus as claimed in claim 1, further comprising a waterproof ring, wherein the waterproof ring is covered on the drain pan.

5. The grinding apparatus as claimed in claim 4, wherein the waterproof ring includes a latching portion, a connecting portion and a brim portion, the latching portion abuts against the drain pan, the connecting portion and the brim portion are parallel to a bottom wall of the drain pan.

6. The grinding apparatus as claimed in claim 1, wherein the transmission module further includes a drive pulley, a belt, a shaft, a support plate, a driven pulley, the drive pulley is fixed to the motor, the driven pulley is rotatably connected to the base, the belt is fitted around the drive pulley and the driven pulley, the support plate is disposed on the base, the shaft is rotatably connected to the support plate, the grinding plate is detachably assembled to one end of the shaft, and the driven pulley is mounted to the other end of the shaft.

7. The grinding apparatus as claimed in claim 6, wherein the transmission module includes an idler pulley, and the idler pulley abuts against the belt.

8. A grinding apparatus comprising:

a base;

a case positioned on the base;

a transmission module positioned on the base, and including a motor, a grinding plate, a drive pulley, a belt, a driven pulley, the drive pulley mounted to the motor, the driven pulley rotatably connected to the base, the grinding plate attached to the driven pulley, the belt fitted around the drive pulley and the driven pulley;

an inlet water module configured for feeding water onto the grinding plates;

a drain module including a drain pan and a drain pipe, the drain pan detachably attached to the case, the drain pipe connected to the drain pan, and exposed from the case; and a waterproof ring;

wherein the waterproof ring is covered on the drain pan.

9. The grinding apparatus as claimed in claim 8, wherein the waterproof ring includes a latching portion, a connecting portion and a brim portion, the latching portion abuts against the drain pan, the connecting portion and the brim portion are parallel to a bottom wall of the drain pan.

10. The grinding apparatus as claimed in claim 8, wherein the drain pan includes a bottom wall, a peripheral wall and a flange, the bottom wall includes a guide hole and a sleeve formed around the guide hole, and a receiving chamber is defined between the sleeve and the peripheral wall, and the flange extends from the peripheral wall.

11. The grinding apparatus as claimed in claim 10, wherein the bottom wall defines an outlet, and a connecting pipe is joined to the outlet, and the drain pipe is connected to the connecting pipe.

12. The grinding apparatus as claimed in claim 11, wherein two latching blocks are formed on the peripheral wall, the case defines a through hole, opposite notches are defined at opposite ends of a diameter of the through hole, the latching blocks are positioned in the notches for preventing the drain pan from vibrating.

* * * * *